US011199184B2

(12) United States Patent
Yamamoto et al.

(10) Patent No.: US 11,199,184 B2
(45) Date of Patent: Dec. 14, 2021

(54) VARIABLE DISPLACEMENT SWASH PLATE COMPRESSOR

(71) Applicant: KABUSHIKI KAISHA TOYOTA JIDOSHOKKI, Aichi (JP)

(72) Inventors: Kenji Yamamoto, Aichi-ken (JP); Noriaki Satake, Aichi-ken (JP); Shinichi Kakegawa, Aichi-ken (JP); Shuhei Sekinaga, Aichi-ken (JP); Shiro Hayashi, Aichi-ken (JP); Akinobu Kanai, Aichi-ken (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 125 days.

(21) Appl. No.: 16/825,211

(22) Filed: Mar. 20, 2020

(65) Prior Publication Data

US 2020/0309106 A1 Oct. 1, 2020

(30) Foreign Application Priority Data

Mar. 28, 2019 (JP) ..... JP2019-063062

(51) Int. Cl.
*F04B 27/18* (2006.01)
*F04B 27/08* (2006.01)

(52) U.S. Cl.
CPC ..... *F04B 27/18* (2013.01); *F04B 27/0891* (2013.01); *F04B 2205/16* (2013.01)

(58) Field of Classification Search
CPC ..... F04B 27/18–2027/1886; F04B 27/0891; F04B 2205/16; G05D 16/00–16/028
See application file for complete search history.

(56) References Cited

U.S. PATENT DOCUMENTS 7,651,321 B2 * 1/2010 Ota ..... F04B 49/225 417/222.2
7,972,119 B2 * 7/2011 Ozeki ..... F04B 27/1036 417/269
8,439,652 B2 * 5/2013 Hayashi ..... F04B 27/1804 417/295
10,612,534 B2 * 4/2020 Kanai ..... F25B 49/022
(Continued)

FOREIGN PATENT DOCUMENTS

JP 2016-169700 9/2016
JP 2019-027336 2/2019
WO WO2017/145798 8/2017

*Primary Examiner* — Bryan M Lettman
(74) *Attorney, Agent, or Firm* — Greenblum & Bernstein, P.L.C.

(57) ABSTRACT

A variable displacement swash plate compressor includes a displacement control valve that is configured to change crank chamber pressure, and an opening adjusting valve that adjusts an amount of refrigerant sucked into a suction chamber. The opening adjusting valve includes a valve case, a first valve element, a second valve element, and an urging spring. The valve case has a valve seat on which the second valve element is seated. The valve seat regulates movement of the second valve element toward the first valve element. A sealing member is provided between an inner peripheral surface of the valve case that defines a second valve chamber and an outer peripheral surface of the second valve element to prevent refrigerant in the second valve chamber so that leakage between a bleed passage and a control passage is prevented.

3 Claims, 6 Drawing Sheets

(56) References Cited

U.S. PATENT DOCUMENTS

| | | | | |
|---|---|---|---|---|
| 2008/0199329 | A1* | 8/2008 | Hayashi | F04B 27/08<br>417/307 |
| 2018/0363637 | A1 | 12/2018 | Kanai et al. | |
| 2019/0032648 | A1 | 1/2019 | Satake et al. | |

* cited by examiner

VARIABLE DISPLACEMENT SWASH PLATE COMPRESSOR

BACKGROUND ART

The present disclosure relates to a variable displacement swash plate compressor.

WO 2017/145798 discloses a conventional variable displacement swash plate compressor (hereinafter, simply referred to as a compressor). This compressor includes a housing, a swash plate, a plurality of pistons, a displacement control valve, and an opening adjusting valve.

The housing is formed with a suction chamber, a plurality of cylinder bores, a crank chamber, and a discharge chamber. The swash plate is provided in the crank chamber, and has an inclination angle that is changed by crank chamber pressure in the crank chamber. Each piston is accommodated in the cylinder bore while engaging with the swash plate, and forms a compression chamber between the piston and the housing. The displacement control valve is configured to change the crank chamber pressure. The opening adjusting valve adjusts the amount of refrigerant sucked into the suction chamber.

The housing is formed with a suction passage connecting an external circuit to the suction chamber, a supply passage connecting the discharge chamber to the crank chamber through the displacement control valve, a bleed passage connecting the crank chamber to the suction chamber, and a control passage allowing the supply passage and the opening adjusting valve to communicate with each other.

The opening adjusting valve has a valve case, a first valve element, a second valve element, and an urging spring. The valve case is formed with a first valve chamber constituting a part of the suction passage and a second valve chamber constituting a part of the bleed passage. The first valve element is provided in the first valve chamber, and adjusts an opening of the suction passage. The second valve element is provided in the second valve chamber and adjusts an opening of the bleed passage. The urging spring is provided across the first valve chamber and the second valve chamber, and urges the first valve element and the second valve element to separate the first valve element and the second valve element from each other.

This compressor enables ensuring quietness at the time of small displacement while preventing pressure loss of suction pressure at the time of large displacement. In addition, high efficiency at the small displacement is feasible without increasing manufacturing cost and lowering a degree of freedom in design. Further, a liquid refrigerant or the like that can be filled in the crank chamber at the time of startup is quickly discharged, and the displacement can be quickly increased.

However, the conventional compressor described above has a demand to further improve quickness in increasing the displacement from a minimum displacement state.

Specifically, this compressor has the second valve element that doses the bleed passage in the minimum displacement state. To increase the displacement from this state, it is conceivable to increase the crank chamber pressure to more than control pressure by the displacement control valve to push down the second valve element. At this time, even when the second valve element is provided with a pressure receiving surface on which crank chamber pressure acts so that the second valve element opens the bleed passage by the crank chamber pressure in a state in which the second valve element doses the bleed passage, it takes some time for the second valve element to open the bleed passage.

The inventors presume the cause as follows. First, a refrigerant under high crank chamber pressure, supplied from the displacement control valve, flows behind the second valve element from the bleed passage through a peripheral surface of the second valve element, and the second valve element is pressed in a direction to close the bleed passage by the high crank chamber pressure. Then, even when the second valve element is slightly separated from the valve case by the high crank chamber pressure and the bleed passage is slightly opened, the refrigerant under the high crank chamber pressure flows into the second valve chamber at a large flow rate. This causes negative pressure between the valve case and the second valve element, so that the second valve element is seated again on the valve case.

The present disclosure is made in view of the above-mentioned conventional circumstances, and directed to providing a variable displacement swash plate compressor that is excellent in quickness to increase displacement from a minimum displacement state.

SUMMARY

In accordance with an aspect of the present disclosure, a variable displacement swash plate compressor includes a housing, a swash plate, a piston, a displacement control valve, and an opening adjusting valve. The housing has a suction chamber, a cylinder bore, a crank chamber, and a discharge chamber. The swash plate is provided in the crank chamber and has an inclination angle that is changed by crank chamber pressure in the crank chamber. The piston is accommodated in the cylinder bore while engaging with the swash plate. The piston forms a compression chamber between the piston and the housing. The displacement control valve is configured to change the crank chamber pressure. The opening adjusting valve adjusts an amount of refrigerant sucked into the suction chamber. The housing has a suction passage connecting the suction chamber to an external circuit, a supply passage connecting the discharge chamber to the crank chamber through the displacement control valve, a bleed passage connecting the crank chamber to the suction chamber, and a control passage connecting the supply passage to the opening adjusting valve. The opening adjusting valve includes a valve case, a first valve element, a second valve element, and an urging spring. The valve case has a first valve chamber forming a part of the suction passage and a second valve chamber forming a part of the bleed passage. The first valve element is provided in the first valve chamber to adjust an opening of the suction passage. The second valve element is provided in the second valve chamber to adjust an opening of the bleed passage. The urging spring is provided across the first valve chamber and the second valve chamber, and urges the first valve element and the second valve element to separate the first valve element and the second valve element from each other. The valve case has a valve seat on which the second valve element is seated. The valve seat regulates movement of the second valve element toward the first valve element. A sealing member is provided between an inner peripheral surface of the valve case that defines the second valve chamber and an outer peripheral surface of the second valve element to prevent refrigerant in the second valve chamber so that leakage between the bleed passage and the control passage is prevented.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

Hereinafter, first and second embodiments that embody the present disclosure will be described with reference to the drawings. Compressors of the first and second embodiments are each a variable displacement swash plate compressor with a single-head piston. These compressors are each mounted on a vehicle and constitute a refrigerating circuit of an air conditioner.

First Embodiment

Figure 1:
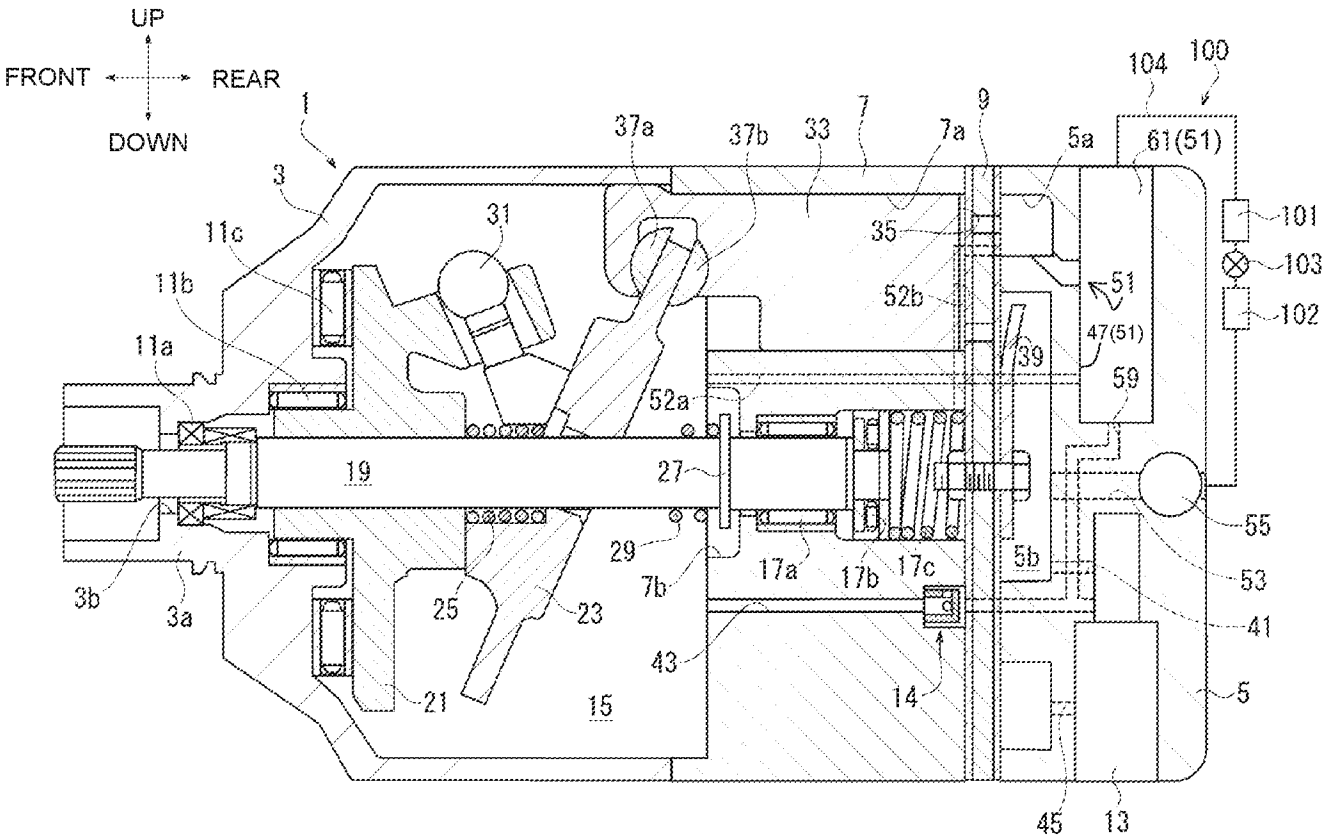
FIG. 1 is a cross-sectional view of a compressor according to a first embodiment.
Figure 2:
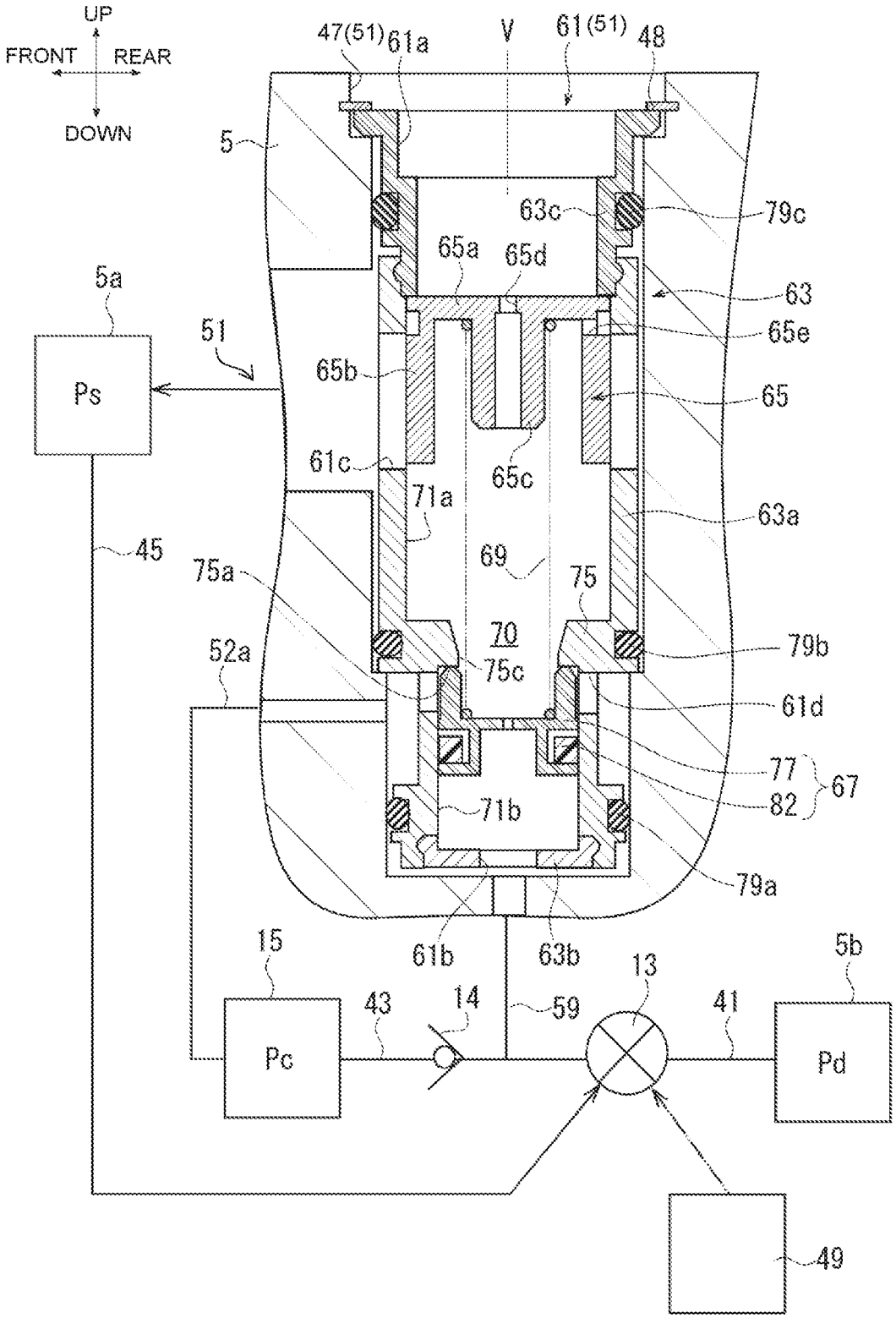
FIG. 2 is an enlarged cross-sectional view of a main part of the compressor according to the first embodiment at the time of minimum displacement.

As illustrated in FIG. 1, the compressor according to the first embodiment has a housing 1 including a front housing 3, a rear housing 5, a cylinder block 7, and a valve unit 9. In the first embodiment, a front-rear direction of the compressor is defined such that a side where the front housing 3 is positioned is a front side of the compressor and a side where the rear housing 5 is positioned is a rear side of the compressor. In addition, an up-down direction of the compressor is defined such that an upper side in a paper-surface of FIG. 1 is an upper side of the compressor, and a lower side in the paper-surface of FIG. 1 is a lower side of the compressor. In FIG. 2 and subsequent drawings, the front-rear direction and the up-down direction are defined corresponding to FIG. 1. In addition, the compressor is appropriately changed in attitude according to the vehicle or the like on which the compressor is mounted.

The front housing 3 is formed with a boss 3*a* protruding forward. The boss 3*a* is formed inside with a first shaft hole 3*b* extending in the front-rear direction of the compressor. In the first shaft hole 3*b*, a shaft sealing device 11*a* and a first radial bearing 11*b* are provided. The front housing 3 is also provided on its rear surface with a first thrust bearing 11*c*.

The rear housing 5 is formed with a suction chamber 5*a* and a discharge chamber 5*b*. In the rear housing 5, a displacement control valve 13, a control check valve 14, a check valve 55, and an opening adjusting valve 61 are provided. The suction chamber 5*a* is positioned in a radially outward portion in the rear housing 5. The suction chamber 5*a* is connected to an evaporator 101 provided outside the compressor through a suction passage 51 described later. The suction chamber 5*a* continues to a valve accommodation chamber 47 formed extending in the radial direction of the rear housing 5. That is, the valve accommodation chamber 47 constitutes a part of the suction passage 51.

The discharge chamber 5*b* is positioned in a radially inward portion in the rear housing 5. The discharge chamber 5*b* is connected to a condenser 102 provided outside the compressor through a discharge passage 53. In the discharge passage 53, the check valve 55 is provided. The evaporator 101, the condenser 102, an expansion valve 103, a pipe 104, and the like constitute an external circuit 100. The compressor and the external circuit 100 constitute the air conditioner.

The cylinder block 7 is positioned between the front housing 3 and the valve unit 9. Between the front housing 3 and the cylinder block 7, a crank chamber 15 is formed. The cylinder block 7 is formed with a plurality of cylinder bores 7*a* at equal angular intervals in the circumferential direction. Each cylinder bore 7*a* communicates with the crank chamber 15 at the front.

The cylinder block 7 has a second shaft hole 7*b* coaxial with the first shaft hole 3*b*. In the second shaft hole 7*b*, a second radial bearing 17*a*, a second thrust bearing 17*b*, and a pressing spring 17*c* are provided.

A drive shaft 19 is inserted into the front housing 3 and the cylinder block 7. The drive shaft 19 is inserted into the shaft sealing device 11*a* in the front housing 3. The drive shaft 19 is also inserted into the second radial bearing 17*a* and the second thrust bearing 17*b* in the cylinder block 7. Accordingly, the drive shaft 19 is supported by the housing 1 and is rotatable about a driving axis of the drive shaft 19, parallel to the front-rear direction.

The drive shaft 19 is press-fitted into a lug plate 21. The lug plate 21 is disposed forward in the crank chamber 15 and is rotatable in the crank chamber 15 as the drive shaft 19 rotates. The first radial bearing 11*b* and the first thrust bearing 11*c* are provided between the lug plate 21 and the front housing 3.

In addition, the drive shaft 19 is inserted into a swash plate 23. The swash plate 23 is positioned behind the lug plate 21 in the crank chamber 15. Between the lug plate 21 and the swash plate 23, an inclination reducing spring 25 is provided around the drive shaft 19. Further, a circlip 27 is fixed to a rear portion of the drive shaft 19, and a return spring 29 is provided around the drive shaft 19 between the circlip 27 and the swash plate 23.

In the crank chamber 15, the lug plate 21 and the swash plate 23 are connected by a link mechanism 31. The link mechanism 31 supports the swash plate 23 such that an inclination angle of the swash plate 23 to a direction orthogonal to the driving axis of the drive shaft 19 can be changed.

Each cylinder bore 7*a* accommodates a piston 33 so as to allow reciprocating motion of the piston 33. Each piston 33 has a rear end surface facing the valve unit 9 in the corresponding one of the cylinder bores 7*a*. Accordingly, each piston 33 partitions the compression chamber 35 behind the corresponding one of the cylinder bores 7*a*.

Between each piston 33 and the swash plate 23, a pair of front and rear shoes 37*a* and 37*b* is provided. Each piston 33 is engaged with the swash plate 23 by the corresponding one of the pairs of shoes 37*a* and 37*b*. Each pair of shoes 37*a* and 37*b* is configured to convert rotation of the swash plate 23 into reciprocating motion of the piston 33. Each piston 33 also can reciprocate in the corresponding one of the cylinder bores 7*a* with a stroke corresponding to the inclination angle of the swash plate 23 using the corresponding one of the pairs of shoes 37*a* and 37*b*.

The valve unit 9 is formed by stacking a suction valve plate, a valve plate, and a discharge valve plate from the front. In the valve unit 9, a suction reed valve, a suction port, a discharge port, and a discharge reed valve are formed corresponding to each cylinder bore 7*a*. The valve unit 9 has a rear surface to which a retainer 39 is fixed. The retainer 39 is disposed in the discharge chamber 5*b* to regulate a maximum opening of the discharge reed valve.

As illustrated in FIGS. 1 and 2, the compressor includes a first bleed passage 52*a* and a second bleed passage 52*b* through which the crank chamber 15 and the suction chamber 5*a* communicate with each other, and as illustrated in FIG. 2, the compressor includes a first supply passage 41 through which the discharge chamber 5*b* and the displacement control valve 13 communicate with each other, a second supply passage 43 connecting the displacement control valve 13 to the crank chamber 15 through the control check valve 14, and a detection passage 45 through which the suction chamber 5*a* and the displacement control valve 13 communicate with each other. The rear housing 5 is formed with a control passage 59. The control passage 59 is connected on one side to the second supply passage 43 at a position closer to the displacement control valve 13 than the control check valve 14, and on the other side to the valve accommodation chamber 47.

The first bleed passage 52*a* is formed in the cylinder block 7, the valve unit 9, and the rear housing 5, and allows the crank chamber 15 and the suction chamber 5*a* to communicate with each other through the opening adjusting valve 61 to adjust a communication area. The second bleed passage 52*b* is formed in the cylinder block 7 and the valve unit 9, and allows the crank chamber 15 and the suction chamber 5*a* to communicate with each other through the second shaft hole 7*b* and the valve unit 9. During OFF operation described below, the first bleed passage 52*a* is dosed, while the second bleed passage 52*b* is open. At the time of startup and maximum displacement operation, both the first bleed passage 52*a* and the second bleed passage 52*b* are in an open state.

As illustrated in FIGS. 1 and 2, the first supply passage 41 and the detection passage 45 are formed in the rear housing 5. The second supply passage 43 is formed in the rear housing 5, the valve unit 9, and the cylinder block 7. The displacement control valve 13 is provided in the rear housing 5. The displacement control valve 13 adjusts the communication area between the first supply passage 41 and the second supply passage 43 based on suction pressure Ps in the suction chamber 5*a* and a control signal from the controller 49.

Figure 3:
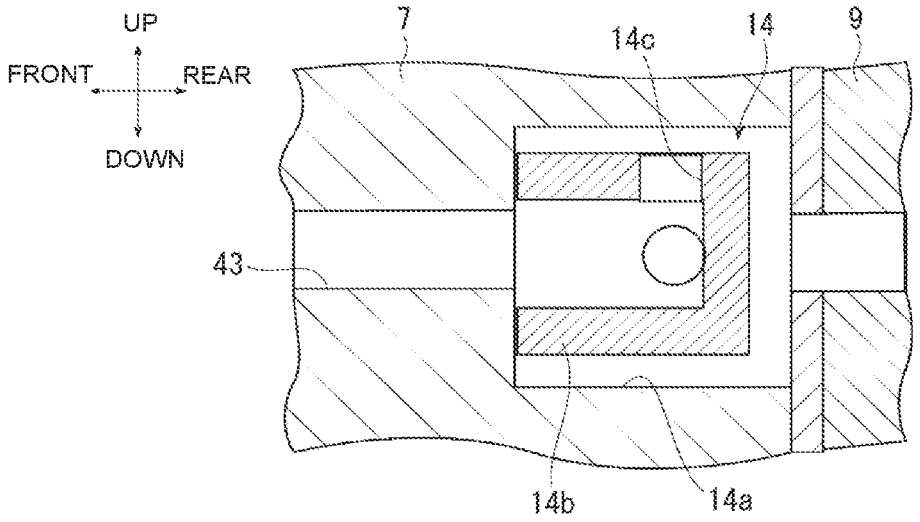
FIG. 3 is an enlarged cross-sectional view of a control check valve of the compressor according to the first embodiment.

The control check valve 14 is provided in the cylinder block 7. As illustrated in FIG. 3, the control check valve 14 includes a valve accommodation chamber 14*a* formed in the cylinder block 7 and a valve element 14*b* accommodated in the valve accommodation chamber 14*a*. The valve accommodation chamber 14*a* is formed in the second supply passage 43 while facing the valve unit 9. The valve element 14*b* has a cap shape, and has an appropriate number of communication holes 14*c* formed in its side wall. The control check valve 14 is configured such that when a refrigerant under high pressure is supplied from the displacement control valve 13 to the second supply passage 43, the valve element 14*b* is moved toward the crank chamber 15 and the refrigerant passes through the communication hole 14*c* to be supplied to the crank chamber 15. On the other hand, when refrigerant under high pressure is not supplied from the displacement control valve 13 to the second supply passage 43, the valve element 14*b* is moved toward the valve unit 9 by crank chamber pressure Pc of the crank chamber 15, and the valve element 14*b* closes the second supply passage 43 of the valve unit 9, and thus the refrigerant in the crank chamber 15 is not supplied from the second supply passage 43 into the first supply passage 41.

Figure 5:
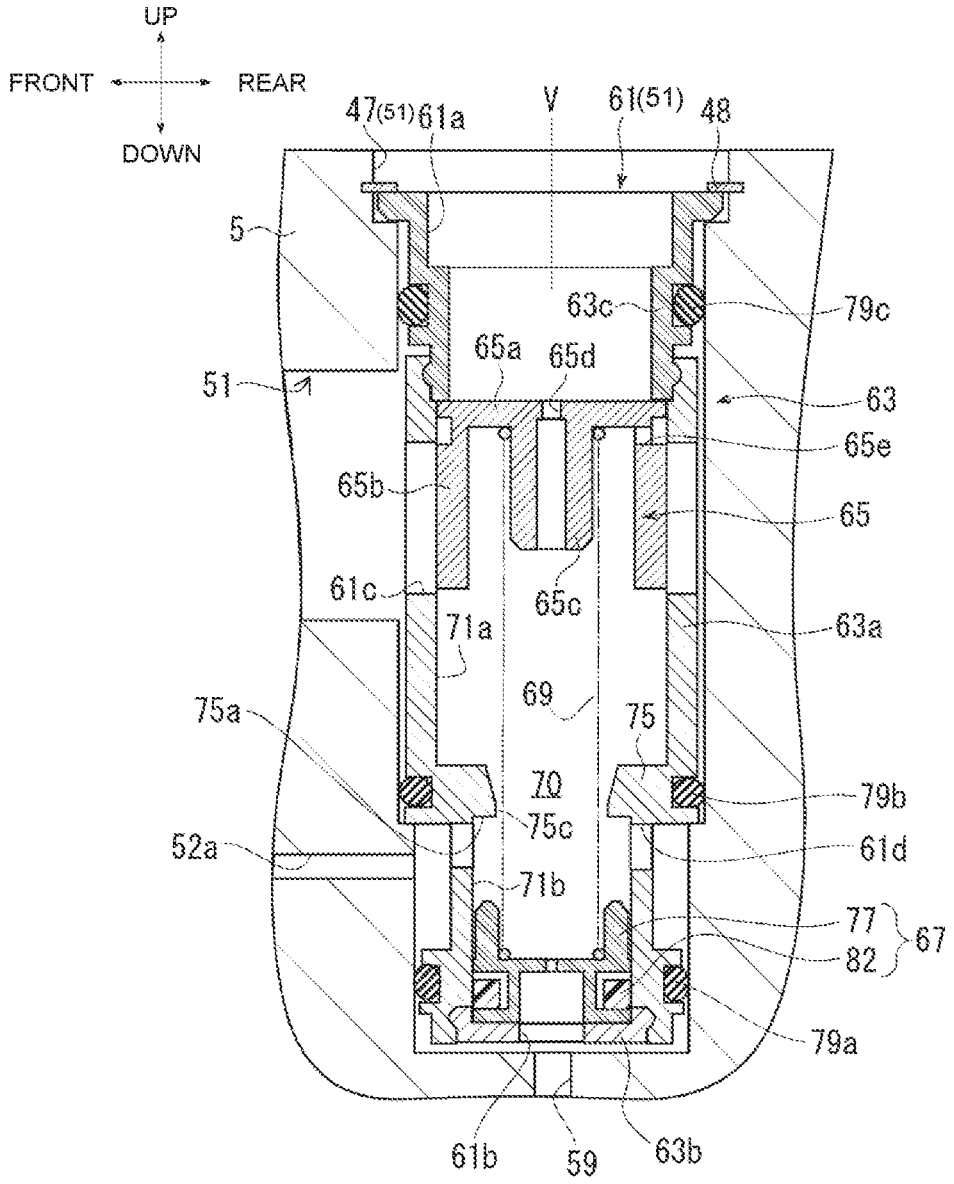
FIG. 5 is an enlarged cross-sectional view of a main part of the compressor according to the first embodiment and the compressor is started up from a minimum displacement state.
Figure 6:
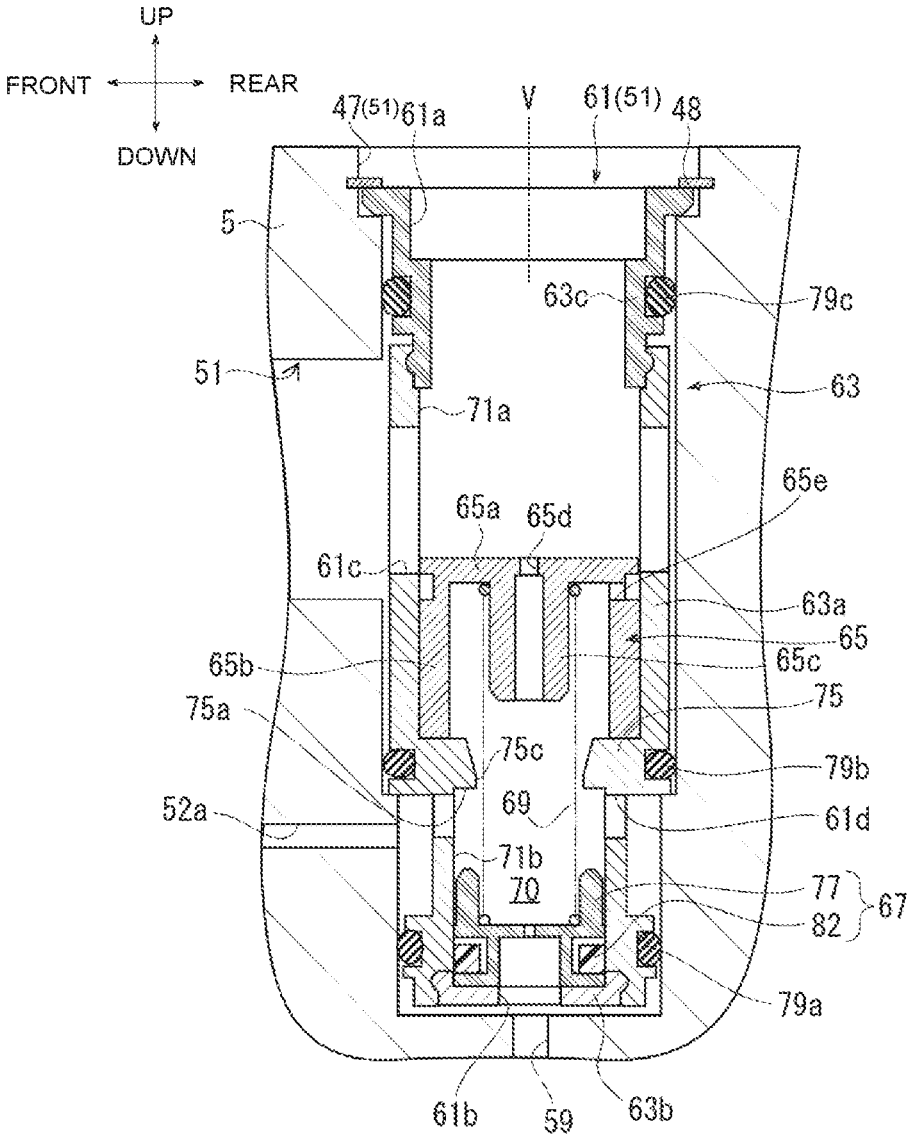
FIG. 6 is an enlarged cross-sectional view of a main part of the compressor according to the first embodiment at the time of maximum displacement.

As illustrated in FIGS. 2, 5, and 6, the valve accommodation chamber 47 of the rear housing 5 is formed in a substantially cylindrical shape extending in the radial direction of the rear housing 5. The opening adjusting valve 61 is provided in the valve accommodation chamber 47. The opening adjusting valve 61 includes a valve case 63, a first valve element 65, a second valve element 67, and a coil spring 69. The valve case 63, the first valve element 65, and the second valve element 67 are each made of resin, and the coil spring 69 is made of metal. The opening adjusting valve 61 holds O-rings 79*a*, 79*b*, and 79*c* in this order from below. The opening adjusting valve 61 is accommodated in the valve accommodation chamber 47 in this state, and is fixed by a circlip 48.

The valve case 63 includes a cylindrical member 63*a* extending in the direction of an axis V of the valve case 63, a cover member 63*b*, and a support member 63*c*. The cylindrical member 63*a* constitutes a peripheral wall of the valve case 63. The cover member 63*b* is fixed to a lower end of the cylindrical member 63*a*. The cover member 63*b* is formed with a communication window 61*b*. The communication window 61*b* communicates with the control passage 59 below the O-ring 79*a*. The support member 63*c* has a cylindrical shape and is fixed to an upper end of the cylindrical member 63*a*, and includes a suction port 61*a* at an upper end of the valve case 63. The suction port 61*a* communicates with the external circuit 100 above the O-ring 79*c*.

The cylindrical member 63*a* is formed with a first valve chamber 71*a* and a second valve chamber 71*b*. The first valve chamber 71*a* has a larger diameter than the second valve chamber 71*b*, and is positioned above the second valve chamber 71*b*. The first valve chamber 71*a* and the second valve chamber 71*b* have a coaxial cylindrical shape extending in the direction of the axis V.

The cylindrical member 63*a* is formed with a plurality of suction windows 61*c* in the circumferential direction. Each suction window 61*c* is positioned between the O-ring 79*b* and the O-ring 79*c*, and communicates with the suction passage 51. The cylindrical member 63*a* also has a plurality of bleed windows 61*d* in the circumferential direction. Each bleed window 61*d* is formed in a radial direction from the outside toward the axis V. Each bleed window 61*d* is positioned between the O-ring 79*a* and the O-ring 79*b*, and communicates with the first bleed passage 52*a*.

Figure 4:
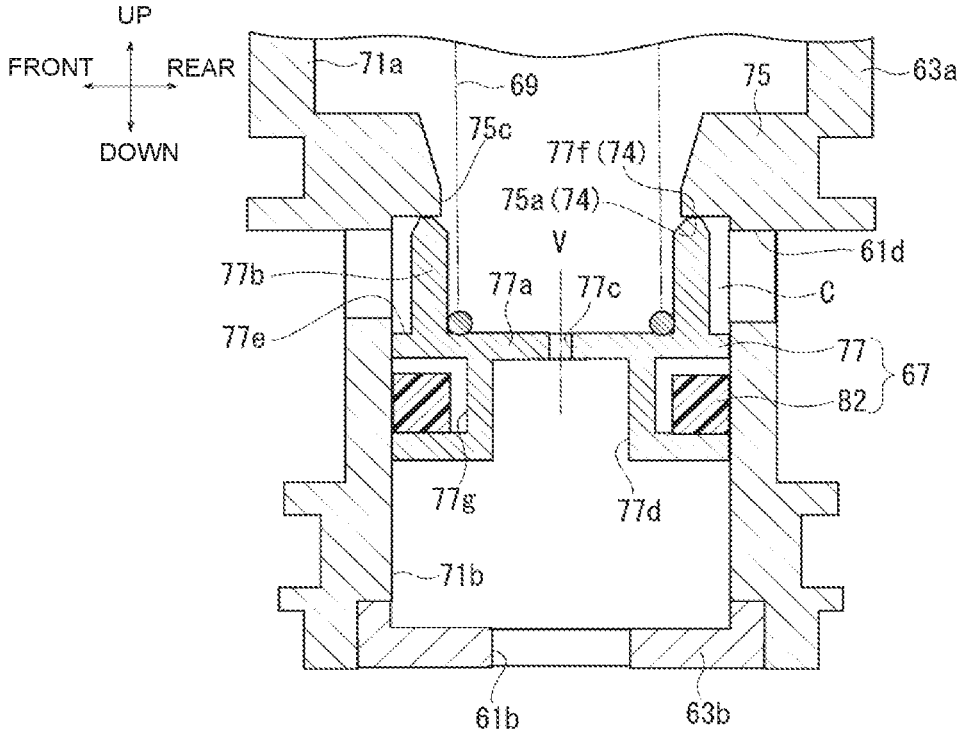
FIG. 4 is an enlarged cross-sectional view of a main part of an opening adjusting valve of the compressor according to the first embodiment at the time of the minimum displacement.

The cylindrical member 63*a* is formed with a protruding portion 75 that protrudes annularly inward between the first valve chamber 71*a* and the second valve chamber 71*b*. The protruding portion 75 is configured to regulate a lower position of the first valve element 65 and an upper position of the second valve element 67. The protruding portion 75 is formed inside with a communication hole 75*c* through which the first valve chamber 71*a* and the second valve chamber 71*b* communicate with each other. As illustrated in FIG. 4, the protruding portion 75 is formed in its lower surface orthogonal to the axis V with a valve seat 75*a* in an annular shape about the axis V.

As illustrated in FIGS. 2, 5, and 6, the first valve element 65 includes a spring receiving portion 65*a*, a first cylindrical portion 65*b*, and a second cylindrical portion 65*c*. The spring receiving portion 65*a* has an annular shape around the axis V, and receives an upper end of the coil spring 69. The spring receiving portion 65*a* is formed with a through hole 65*d* communicating with the inside of the second cylindrical portion 65*c*. The through hole 65*d* allows the suction passage 51 on an evaporator 101 side to communicate with the first valve chamber 71*a*. The first cylindrical portion 65*b* extends downward in the direction of the axis V from an outer peripheral edge of the spring receiving portion 65*a*. The first cylindrical portion 65*b* has a cylindrical shape around the axis V, and has a peripheral surface facing the suction window 61*c*. The first cylindrical portion 65*b* is formed with a communication hole 65*e* passing through the first cylindrical portion 65*b*. The communication hole 65*e* allows a space 70 between the first valve element 65 and the second valve element 67 to communicate with the suction chamber 5*a* through the suction window 61*c*. The second cylindrical portion 65*c* extends downward in the direction of the axis V from the spring receiving portion 65*a* inside the first cylindrical portion 65*b*. The second cylindrical portion 65*c* has a cylindrical shape around the axis V, and holds the upper end of the coil spring 69 on its outer peripheral surface.

The first valve element 65 is accommodated in the first valve chamber 71*a*, and is slidable in the first valve chamber 71*a* in the direction of the axis V of the valve case 63, i.e., in the up-down direction of the compressor. As illustrated in FIGS. 2 and 5, the first valve element 65 is slidable upward until coming into contact with the support member 63*c*. In this state, the first cylindrical portion 65*b* reduces an opening of the suction window 61*c*. As illustrated in FIG. 6, the first valve element 65 is also slidable downward until coming into contact with the protruding portion 75. In this state, the first cylindrical portion 65*b* completely opens the suction window 61*c*.

As illustrated in FIG. 4, the second valve element 67 includes a second valve element main body 77 and a tip seal 82. The second valve element main body 77 includes a spring receiving portion 77*a* and a cylindrical portion 77*b*. The spring receiving portion 77*a* has an annular shape around the axis V and receives a lower end of the coil spring 69. The spring receiving portion 77*a* has an outer peripheral surface with an annular seal groove 77*g* around the axis V, and the tip seal 82 is provided or held in the seal groove 77*g*. The spring receiving portion 77*a* has a lower surface formed with a recessed portion 77*d* recessed upward. The spring receiving portion 77*a* is formed with a through hole 77*c* extending along the axis V. The through hole 77*c* allows the second valve chamber 71*b* on a cover member 63*b* side to communicate with the first valve chamber 71*a* through the recessed portion 77*d*. The communication window 61*b* is formed in the cover member 63*b*, so that the communication window 61*b* allows the inside of the second valve chamber 71*b* to communicate with the outside of the second valve chamber 71*b*.

The cylindrical portion 77*b* extends upward in the direction of the axis V from a position slightly closer to the axis V from the outer peripheral edge of the spring receiving portion 77*a*. The cylindrical portion 77*b* has a cylindrical shape about the axis V and has a peripheral surface that faces the bleed window 61*d* while forming a gap C with the bleed window 61*d*. This allows the second valve element main body 77 to have a pressure receiving surface 77*e* under the gap C, on which the crank chamber pressure Pc acts. The pressure receiving surface 77*e* has an annular shape around the axis V.

The cylindrical portion 77*b* is formed in its upper surface orthogonal to the axis V with a contact surface 77*f* in an annular shape about the axis V. The contact surface 77*f* can come into contact with the valve seat 75*a* of the protruding portion 75 of the valve case 63. That is, the second valve element 67 is seated on the valve seat 75*a* of the valve case 63 when the second valve element 67 is closed. The lower end of the coil spring 69 is held by an inner peripheral surface of the cylindrical portion 77*b*.

The tip seal 82 is made of polytetrafluoroethylene (PTFE), and seals a gap between an outer peripheral surface of the second valve element main body 77 and an inner peripheral surface of the cylindrical member 63*a* while allowing the second valve element main body 77 and the cylindrical member 63*a* to slide relative to each other in the direction of the axis V. The tip seal 82 corresponds to the sealing member of the present disclosure.

The second valve element 67 is accommodated in the second valve chamber 71*b*, and is slidable in the second valve chamber 71*b* in the direction of the axis V of the valve case 63, i.e., in the up-down direction of the compressor. The second valve element 67 is slidable upward until the cylindrical portion 77*b* comes into contact with the protruding portion 75. In this state, the contact surface 77*f* forms a regulation portion 74 together with the valve seat 75*a*.

As illustrated in FIGS. 2, 5, and 6, the coil spring 69 is held between the spring receiving portion 65*a* and the second cylindrical portion 65*c* of the first valve element 65, and the spring receiving portion 77*a* and the cylindrical portion 77*b* of the second valve element 67. The coil spring 69 separates the first valve element 65 from the second valve element 67 in the direction of the axis V using its urging force. The coil spring 69 corresponds to the urging spring of the present disclosure.

In this compressor, the drive shaft 19 is driven to rotate by an engine or a motor of a vehicle, and the lug plate 21 and the swash plate 23 rotate to reciprocate each piston 33 in the corresponding one of the cylinder bores 7*a*. At this time, each piston 33 is reciprocated in the corresponding one of the cylinder bores 7*a* with a stroke corresponding to the inclination angle of the swash plate 23. This causes each piston 33 to suck the refrigerant in the suction chamber 5*a* into the compression chamber 35, compress the refrigerant in the compression chamber 35, and discharge the refrigerant under high pressure from the compression chamber 35 to the discharge chamber 5*b*. The suction chamber 5*a* sucks the refrigerant from the external circuit 100 through the opening adjusting valve 61. The discharge chamber 5*b* discharges the refrigerant under high pressure to the external circuit 100 when the check valve 55 is opened by discharge pressure Pd.

During this time, displacement of the compressor can be appropriately changed by adjusting the crank chamber pressure Pc of the crank chamber 15 using the displacement control valve 13. For example, when the displacement control valve 13 increases the communication area between the first supply passage 41 and the second supply passage 43, the refrigerant under the discharge pressure Pd in the discharge chamber 5*b* easily flows into the crank chamber 15, and thus the crank chamber pressure Pc increases. In this case, the inclination angle of the swash plate 23 decreases, so that displacement per one rotation of the drive shaft 19 decreases. When the displacement control valve 13 reduces the communication area between the first supply passage 41 and the second supply passage 43, the refrigerant under the discharge pressure Pd is less likely to flow into the crank chamber 15. On the other hand, when the refrigerant in the crank chamber 15 flows into the suction chamber 5*a* through the first bleed passage 52*a*, the second bleed passage 52*b*, and the opening adjusting valve 61, the crank chamber pressure Pc decreases. In this case, the inclination angle of the swash plate 23 increases, so that the displacement increases.

In this compressor, set suction pressure and sett crank chamber pressure are previously provided. In the present embodiment, valve opening pressure when the first valve element 65 is opened is defined as the set suction pressure, and valve closing pressure when the second valve element 67 is closed is defined as the set crank chamber pressure. Magnitude of the set suction pressure and the set crank chamber pressure can be provided as appropriate.

When the engine of the vehicle is turned on, the compressor is operated in the minimum displacement state (off state). During this time, the displacement control valve 13 is opened by a signal from the controller 49. Accordingly, the control check valve 14 is in an open state to allow the discharge chamber 5*b* to communicate with the crank chamber 15, so that control pressure Pcv through the displacement control valve 13 is higher than the crank chamber pressure Pc. This causes the opening adjusting valve 61 to operate such that the first valve element 65 slides upward to reduce the opening of the suction window 61*c*, and the second valve element 67 slides upward to close the bleed window 61*d*, as illustrated in FIG. 2.

More specifically, as illustrated in FIG. 4, the second valve element 67 comes into contact with the protruding portion 75 of the valve case 63 to form the regulation portion 74. Then, the regulation portion 74 regulates the refrigerant flowing from the bleed window 61*d* into the suction chamber 5*a* through the second valve chamber 71*b*, the first valve chamber 71*a*, the suction window 61*c*, and the suction passage 51.

When the vehicle stops for a long time, or the air conditioner is stopped and a long time elapses, the refrigerant in the crank chamber 15 may be cooled to become a liquid refrigerant. In this state, when the air conditioner is turned on and the compressor starts up, the first valve element 65 is positioned at an upper position in the first valve chamber 71*a* by the urging force of the coil spring 69 to cause each suction window 61*c* to have a minimum opening. The displacement control valve 13 is closed by a signal from the controller 49 to reduce communication area between the discharge chamber 5*b* and the crank chamber 15. At this time, while the control pressure Pcv is reduced, the crank chamber pressure Pc is higher than the control pressure Pcv due to presence of the liquid refrigerant in the crank chamber 15, and thus the control check valve 14 is closed.

The second valve element 67 has one end surface on which the crank chamber pressure Pc acts, and the other end surface on which the control pressure Pcv acts. At this time, a refrigerant under the high crank chamber pressure Pc is supplied to the gap C from the bleed window 61*d*. Accordingly, the crank chamber pressure Pc acts on the pressure receiving surface 77*e*, so that the valve seat 75*a* and the contact surface 77*f* are pushed by the refrigerant under the crank chamber pressure Pc to be separated from each other. This causes the second valve element 67 to slide downward to open the bleed window 61*d*. At this time, the urging force of the coil spring 69 also acts in a direction of sliding the second valve element 67 downward.

The refrigerant flowing behind the second valve element 67 is prevented from leaking by the tip seal 82, so that the second valve element 67 is moved in the second valve chamber 71*b* by differential pressure between the crank chamber pressure Pc and the control pressure Pcv to be promptly positioned at a lower position, and thus the second valve chamber 71*b* allows each bleed window 61*d* to be open.

Accordingly, the liquid refrigerant accumulated in the crank chamber 15 at the time of startup moves quickly to the suction chamber 5*a* through each bleed window 61*d*, the second valve chamber 71*b*, the first valve chamber 71*a*, and the suction window 61*c*. This causes this compressor to have the crank chamber pressure Pc that quickly decreases, so that the compressor is likely to be quickly increased in displacement.

As illustrated in FIG. 5, the second valve element 67 slides downward until coming into contact with the cover member 63*b* as time elapses. During this time, the tip seal 82 seals the refrigerant that is about to flow behind the second valve element 67 from the bleed window 61*d* through the peripheral surface of the second valve element main body 77. In addition, the refrigerant under the crank chamber pressure Pc flowing around the peripheral surface of the second valve element main body 77 from the bleed window 61*d* is likely to flow behind the tip seal 82 in the seal groove 77*g*, so that the crank chamber pressure Pc is likely to be applied to the seal groove 77*g*. This causes the crank chamber pressure Pc to be easily transmitted to the second valve element main body 77. Further, the tip seal 81 made of PTFE is employed, so that the second valve element main body 77 easily slides in the direction of the axis V in the second valve chamber 71*b*, and thus the second valve element 67 is improved in responsiveness.

Accordingly, the refrigerant in the crank chamber 15 flows into the suction chamber 5*a* through the first bleed passage 52*a*, the bleed window 61*d*, the second valve chamber 71*b*, the first valve chamber 71*a*, the suction window 61*c*, and the suction passage 51, so that the crank chamber pressure Pc decreases quickly and the inclination angle of the swash plate 23 increases quickly. Then a displacement state quickly shifts to a maximum displacement state illustrated in FIG. 6.

Thus, this compressor is excellent in quickness in increasing the displacement from the minimum displacement state.

Even when the compressor becomes the maximum displacement state again after becoming the minimum displacement state (off operation state) during operation, the second valve element 67 is required to move from the upper position at which the bleed window 61*d* is closed as illustrated in FIG. 2 to the lower position at which the bleed window 61*d* is opened as illustrated in FIG. 6.

At the time of the maximum displacement, the displacement control valve 13 reduces the communication area between the discharge chamber 5*b* and the crank chamber 15 in response to a signal from the controller 49. The crank chamber pressure Pc is higher than the control pressure Pcv in the second supply passage 43 due to blow-by gas from the compression chamber 35, and thus the control check valve 14 is closed.

The opening adjusting valve 61 has the suction pressure Ps higher than the set suction pressure, so that the first valve element 65 is moved downward by suction refrigerant. The crank chamber pressure Pc acts on the pressure receiving surface 77*e* of the second valve element 67, so that the valve seat 75*a* and the contact surface 77*f* are pushed by the refrigerant under the crank chamber pressure Pc to be separated from each other. This causes the second valve element 67 to slide downward to open the bleed window 61*d*. Even at this time, the presence of the tip seal 82 prevents the refrigerant flowing behind the second valve element 67 from leaking, so that the second valve element 67 moves quickly to allow a displacement state to quickly shift to the maximum displacement state.

Second Embodiment

Figure 7:
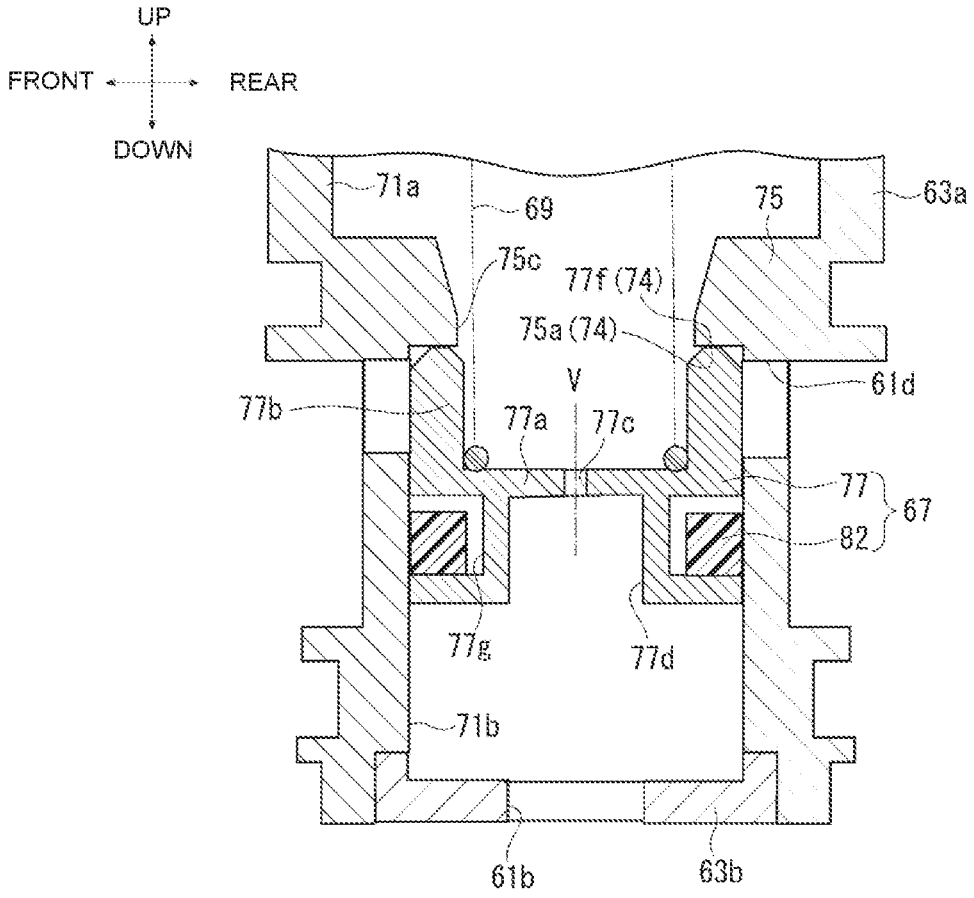
FIG. 7 is an enlarged cross-sectional view of a main part of an opening adjusting valve of a compressor according to a second embodiment and the compressor is in a state immediately after startup.

As illustrated in FIG. 7, the compressor of the second embodiment does not have the gap C between the peripheral surface of the cylindrical portion 77*b* and the bleed window 61*d*, so that the second valve element main body 77 does not have the pressure receiving surface 77*e*. Other configurations are similar to those in the first embodiment.

While this compressor cannot obtain the function and effect of the pressure receiving surface 77*e*, function and effect similar to those in the first embodiment can be achieved.

While in the above, the present disclosure is described with reference to the first and second embodiments, the present disclosure is not limited to the first and second embodiments, and thus it is needless to say that the present disclosure may be appropriately modified without departing from the spirit thereof.

For example, while in the first and second embodiments, the tip seal 82 is provided in the seal groove 77*g* of the second valve element main body 77, a sealing member may be provided in the valve case 63.

Although the compressors of the first and second embodiments each include the suction chamber 5*a* that is integrated with the valve accommodation chamber 47, the suction chamber 5*a* and the valve accommodation chamber 47 may be configured to be connected to each other by a passage while being separated from each other.

The present disclosure is available for an air conditioner or the like of a vehicle.

What is claimed is:

1. A variable displacement swash plate compressor comprising:

a housing having a suction chamber, a cylinder bore, a crank chamber, and a discharge chamber;

a swash plate provided in the crank chamber, the swash plate having an inclination angle that is changed by a crank chamber pressure in the crank chamber;

a piston accommodated in the cylinder bore while engaging with the swash plate, the piston forming a compression chamber between the piston and the housing;

a displacement control valve configured to change the crank chamber pressure; and an opening adjusting valve that adjusts an amount of refrigerant sucked into the suction chamber, the housing having a suction passage connecting the suction chamber to an external circuit, a supply passage connecting the discharge chamber to the crank chamber through the displacement control valve, a bleed passage connecting the crank chamber to the suction chamber, and a control passage connecting the supply passage to the opening adjusting valve, the opening adjusting valve including:

a valve case having a first valve chamber forming a part of the suction passage and a second valve chamber forming a part of the bleed passage;

a first valve element provided in the first valve chamber to adjust an opening of the suction passage;

a second valve element provided in the second valve chamber to adjust an opening of the bleed passage; and an urging spring that is provided across the first valve chamber and the second valve chamber, and that urges the first valve element and the second valve element to separate the first valve element and the second valve element from each other, wherein the valve case has a valve seat on which the second valve element is seated, the valve seat regulating movement of the second valve element toward the first valve element, and wherein a sealing member is provided between an inner peripheral surface of the valve case that defines the second valve chamber and an outer peripheral surface of the second valve element to seal refrigerant in the second valve chamber so that leakage between the bleed passage and the control passage is prevented.

2. The variable displacement swash plate compressor according to claim 1, wherein the valve case has a bleed window that is formed through a peripheral wall of the valve case and allows the second valve chamber to communicate with the bleed passage, and the second valve element includes a spring receiving portion that holds the sealing member while receiving the urging spring, and a cylindrical portion that extends from the spring receiving portion toward the first valve element in a direction of an axis of the valve case, the cylindrical portion having at a distal end thereof a contact surface, the cylindrical portion having a peripheral surface facing the bleed window.

3. The variable displacement swash plate compressor according to claim 2, wherein the second valve element includes a pressure receiving surface that has an annular shape around the axis and receives the crank chamber pressure.

* * * * *